US005191508A

United States Patent [19]

Axelson et al.

[11] Patent Number: 5,191,508

[45] Date of Patent: Mar. 2, 1993

[54] CERAMIC IGNITERS AND PROCESS FOR MAKING SAME

[75] Inventors: Scott R. Axelson, Milford. N.H.; John T. Vayda, West Brookfield, Mass.

[73] Assignee: Norton Company, Worcester, Mass.

[21] Appl. No.: 884,662

[22] Filed: May 18, 1992

[51] Int. Cl.[5] ..... F23Q 3/00; F23Q 7/10

[52] U.S. Cl. ..... 361/257; 361/264

[58] Field of Search ..... 361/256, 257; 317/98; 252/516

[56] References Cited

U.S. PATENT DOCUMENTS

| | | | |
|---|---|---|---|
| 3,875,476 | 4/1975 | Crandall et al. | 317/98 |
| 3,875,477 | 4/1975 | Fredriksson et al. | 317/98 |
| 5,085,804 | 2/1992 | Washburn | 252/516 |

*Primary Examiner*—Donald A. Griffin

*Attorney, Agent, or Firm*—Arthur A. Loiselle, Jr.

[57] ABSTRACT

A process for producing a ceramic igniter comprising forming a slot in a green igniter body prior to densification and inserting into the slot an electrically non-conductive material is described. In addition, a ceramic igniter containing a slot insert produced by the process of the invention is disclosed. The inventon is particularly directed to single and double hairpin-shaped igniters.

17 Claims, 1 Drawing Sheet

CERAMIC IGNITERS AND PROCESS FOR MAKING SAME

TECHNICAL FIELD

This invention is directed to ceramic igniters and an improved method of making the igniters. More particularly, it is directed to hairpin-shaped igniters containing one or more slots filled with an electrically non-conductive material.

BACKGROUND OF THE INVENTION

Ceramic igniters such as those used in fuel burning devices including domestic and industrial liquid fuel and gas burning appliances are well known in the art. See, for example, U.S. Pat. Nos. 3,875,477; 3,928,910; 3,875,477 and Re. 29,853. Despite the recent interest in ceramic igniters, the conventional pilot light igniter still enjoys widespread use. The pilot light, however, is an energy wasting igniting system since it constantly burns. In fact, surveys reveal that pilot light use is responsible for over 10% of the total gas consumed in the United States yearly. Despite this disadvantage, ceramic igniters have not replaced pilot lights on a widespread basis for a number of reasons including their high cost and lack of strength and reliability.

One of the key elements that contributes to the high cost of ceramic igniters is the process used to make the igniters. While igniters exist in various shapes and configurations, the hairpin-shaped igniters are the most popular due to the design being cost effective to manufacture because of the relatively simple forming, firing and assembly techniques required. Also, when an element does fail, fractured pieces of the ceramic will generally fall away from the electric current source minimizing the likelihood of an electrical short which could damage control electronics, valves, motors, etc. in the appliance.

The process used to prepare such hairpin-shaped igniters generally comprises forming a composite of ceramic powders by pressing a mixture of powders to about 60–70% of its theoretical density to form a billet in the green state. The hot pressed billet is than sliced into pieces or tiles. The tiles are then boron nitride coated and densified. To form the desired hairpin-shape, the densified tile is then slotted using a diamond wheel. The process of slotting the tiles, when in the dense state, is costly and complex. One apparent solution to this cost and technical problem would be to pre-slot the tiles in the green state. Pre-slotting, however, has not heretofore worked since the pre-slotted hairpin igniters were found to fracture during the subsequent densification process.

Accordingly, it is an object of the present invention to develop a ceramic igniter which can be manufactured simply and at a relatively low cost while also being structurally stable.

SUMMARY OF THE INVENTION

According to the present invention, ceramic igniters are prepared by (i) forming a ceramic body from ceramic powders, which powders when combined together are electrically conductive; (ii) while still in its green state forming at least one slot in the ceramic body; (iii) inserting into that slot an electrically non-conducting material; and (iv) thereafter, densifying the entire ceramic body so as to bond the electrically conductive body portion to the electrically non-conductive slot insert. Since the igniters are usually mass produced, a billet of igniters will usually be formed in this fashion and, after the densification step, the billet cut into individual igniters. It is important to the process that the material used as the insert in the slot have substantially the same coefficient of thermal expansion as does the main body portion of the igniter. Without such compatibility the igniter is structurally unstable and may fracture in manufacture or use.

The igniter produced according to this process is relatively inexpensive when compared to similar prior art igniters since the slotting operation is performed on a ceramic body when it is in a green state, i.e. before complete densification. Moreover, the hot zone size of the igniter can be increased due to heating of the slot insert material in use. This is an important advantage for igniters used in high velocity burners. Finally, it has been found that the slot insert increases the strength of the igniter.

DETAILED DESCRIPTION OF THE PREFERRED EMBODIMENT

Figure 1:
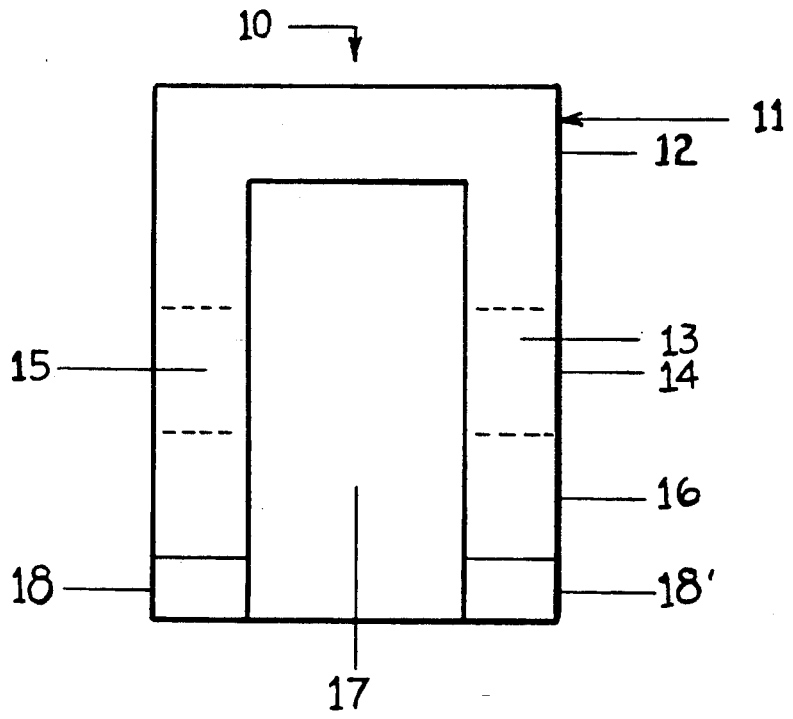
FIG. 1 is a plan view of an igniter body in accordance with the present invention.

For eases of reference, the present invention will now be described with reference to a single hairpin-shaped igniter. It is, however, understood that this invention may be used with any shaped igniter wherein slotting of a ceramic body is required to be carried out to arrive at the final igniter configuration. Such igniter configurations include a double hairpin configuration as shown in U.S. Pat No. 3,875,477 and a single hairpin configuration as shown in U.S. Pat. No. 5,045,237.

As best shown in the drawings, a ceramic igniter 10 according to the present invention comprises a U- or single hairpin-shaped body 11 having legs 13 and 15. A slot which is filled with electrically non-conductive material 17 is disposed between the legs 13 and 15. Electrical connection pads 18 and 18' are located at the ends of legs 13 and 15 for use in connecting the igniter to a source of electric current. The body portion 11 of the igniter is made from a suitable ceramic material or mixture of such materials which forms an electrically conductive material or composite. While any suitable materials may be employed, the conductive component of the ceramic is preferably comprised of molybdenum disilicide, ($MoSi_2$) and silicon carbide (SiC).

A preferred igniter composition comprises about 40 to 70 volume percent of a nitride ceramic and about 30 to 60 volume percent $MoSi_2$ and SiC in a volume ratio of from about 1:3 to 3:1. A more preferred igniter has a varying composition as indicated in FIG. 1 hereof. In such a case, the chemical composition of the igniter 10 is varied from a highly resistive portion 12 through an intermediate portion 14 to a highly conductive hot zone portion 16. Alternatively and even more preferably the intermediate portion 14 is omitted (for ease of manufacturing).

The highly resistive portion 12 of the preferred igniter 10 is preferably comprised of about 50 to 70 volume percent nitride ceramic and about 30 to 50 volume percent $MoSi_2$ and SiC in a volume ratio of about 1:1. The highly conductive portion 16 is preferably comprised of about 45 to 55 volume percent nitride ceramic and about 45 to 55 volume percent $MoSi_2$ and SiC in a volume ratio of from about 1:1 to about 3:2. Suitable nitrides for use as the resistive component of the ceramic igniter include silicon nitride, aluminum nitride, boron nitride, and mixtures thereof. Preferably the nitride is aluminum nitride.

Other igniters in accordance herewith may be produced from single conductive ceramic compositions in known manners. For example, a highly conductive hot zone area of a single conductive composition can be produced by (i) imbedding a more conductive metal rod in the hot zone area or (ii) forming the conductive composition into a thinner cross-section. Another alternative is to utilize the entire conductive ceramic body as the hot zone and attach more resistive leads thereto. As these are known igniter structures, further details are available in the literature and thus are not included here.

By "highly resistive" is meant that the section has a resistivity in the temperature range of 1000° to 1600° C. of at least about 0.04 ohm-cm, preferably at least 0.07 ohm-cm. By "highly conductive" is meant that the section has a resistivity in the temperature range of 100° to 800° C. of less than about 0.005 ohm-cm, preferably less than about 0.003 ohm-cm, and most preferably less than as about 0.001 ohm-cm.

The material used to form the slot insert 17 needs to have a coefficient of thermal expansion which is substantially the same, i.e. within about ±50%, preferably within about ±35%. The slot insert material needs to be non-conductive as well as not fully dense. It should be about 50 to 95%, preferably about 60 to 90%, and most preferably about 65 to 80%, dense. When the insert material is more or less dense, it has been found that the igniter body often cracks or breaks during its subsequent densification by hot isostatic pressing (HIPping). Suitable such materials include alumina, aluminum nitride, beryllium oxide, and the like. It is currently preferable to employ alumina which is about 65 to 75% dense.

The first step in forming the igniters of the present invention comprises forming conductive ceramic powders which eventually will form the body portion 11 of the igniter into a flat substrate. This is preferably accomplished by warm pressing the powders to less than 100% of their theoretical density and preferably to from about 55 to 70%, most preferably to from about 63 to 65% of their theoretical density. This warm pressing is generally carried out in accordance with conventional techniques known in the art. The resulting green warm pressed block is then machined into the desired shape tiles, preferably rectangular, of the desired dimensions, i.e. height and thickness. Thereafter, a slot or slots depending upon the desired configuration of the igniter is formed in the green substrate body by conventional techniques such as grinding, cutting, creepfeeding, and the like.

The slot insert is machined to the size necessary to fit into the slot or slots snugly and then pushed into the slot and fit therein. Preferably, the slot insert material has a thickness within about 0.002 inches of the thickness of the slot so that a tight fit is obtained. Also preferably the slot insert is machined and inserted into the slot so that its edges are flush with the surface of the substrate or body portion 11 of the igniter.

After the slot insert is secure, the entire igniter system is densified by techniques known in the art. It is presently preferred to perform the densification by hot isostatic pressing (HIPping) in accordance with conventional procedures. Suitable conditions for HIPping include temperatures of greater than about 1600° C., pressures greater than about 1500 psi, and a time of at least about 30 minutes at temperature. The densification step acts to bond the slot insert to the igniter body 12 so as to form a strong integral unit which, because of its integral structure, has been found to be stronger than conventional hairpin-shaped igniters. The resulting igniter, if necessary, is machined to its final dimensions and is ready for use after electrical connections are made thereto. If the igniters are being mass produced, a preferred procedure is to form a relatively large billet or strip of ceramic igniter composition, fitting a slot insert therein, densifying the billet, and then cutting it into individual igniters and providing electrical connections to each igniter.

The following non-limiting Example will now further describe the present invention. All parts and percents are by volume unless otherwise specified.

EXAMPLE

The green pieces for this test were formed by mixing the constituent powder in isopropyl alcohol for 90 minutes and then allowing the mixture to dry. The resistive section contained 13 vol % $MoSi_2$, 27 vol % SiC, and 60 vol % AlN, while the highly conductive section contained 25 vol % $MoSi_2$, 45 vol % SiC, and 30 vol % AlN. Hot pressing was used to consolidate the powders into easily machinable shapes.

The resistive powder mixture was placed into a graphite hot pressing die 6.25" square and scythed to form a level surface. The conductive powder mixture was poured on top of this layer and also scythed to level the surface. A graphite pressing block for the mold was then placed on top of this powder surface. The mold was then fired in a hot pressing station to 1455° C. for 2 hours and 150 tons pressure. Argon gas was used as a cover gas in the induction furnace cavity.

The consolidated blocks were removed from the mold and then sliced into rectangular tiles. The tiles were now ready for the next machining step to produce preslotted tiles. The hot pressed tiles were each machined to an overall height of 1.65±0.05 inches and a thickness of 0.240±0.020 inches. A slot 1.535 inches deep, with the slot depth in the resistive region being 0.385±0.080 inches. A 15% dimensional shrinkage factor was utilized to obtain these green dimensions for the hot pressed tiles. A-14 alumina (Alcoa Co.) plates which were about 65% dense, 3×3×0.065 inches, were used to form the slot inserts. The slot widths were 0.040, 0.045, 0.050, and 0.060 inches (two at each dimension), and the alumina substrates were ground to fit snugly into these slot dimensions. The slot inserts were cut so that they and the edges of the igniter tiles edges were flush after they were inserted.

The tiles with the inserts were then boron nitride-coated and densified by hot isostatically pressing by a glass-encapsulation HIPping process at 1790° C. 30 ksi, for 1 hour. After HIPping, the surfaces were ground to final element dimensions and the tile was sliced into 0.030–0.035" thick hairpin pieces. The tiles were broken out of the glass encapsulant, sandblasted to remove any remaining surface coating, and then machined into igniters. The tiles were cut into igniters having leg widths of about 0.052", an overall resistor height of about 0.389", and a thickness of about 0.030".

At 24.02 volts the resulting igniters averaged 1308° C. at 1.44 amps. The elements did not break from being energized and the temperature in the alumina filled slot was less than 50° C. lower than the element temperature. A reaction zone between the igniter and the slot insert material had formed; attempts to separate the igniter and the slot insert material by pulling on the legs of the igniter failed to break the igniters. The composite structure appeared stronger than the standard hairpin production igniters.

COMPARATIVE EXAMPLE

The procedure of the Example was repeated except that the alumina slot insert tiles were replaced with fully pre-densified alumina insert materials. During densification of the hot pressed electrically conductive tiles, the tiles cracked and were not usable to form the intended igniters.

What is claimed is:

1. A process for forming a ceramic igniter comprising (i) forming an electrically conductive ceramic body member in a green state; (ii) forming at least one slot in said green body member; (iii) inserting into the slot an electrically nonconductive material which is about 50 to about 95% dense and has a coefficient of thermal expansion which is within about ±50% of the coefficient of thermal expansion of the electrically conductive ceramic body member; and (iv) densifying the resulting structure.

2. The process of claim 1, wherein the densifying step is carried out by hot isostatic pressing.

3. The process of claim 1, wherein three slots are formed in the body member.

4. The process of claim 1, wherein the ceramic body member is formed by warm pressing ceramic powders.

5. The process of claim 1, wherein the electrically conductive ceramic is a mixture of a nitride ceramic and a conductive component selected from any of molybdenum disilicide, silicon carbide or mixtures thereof.

6. The process of claim 1, wherein the electrically non-conductive material is selected from any of alumina, beryllium oxide, and aluminum nitride.

7. The process of claim 6, wherein the electrically non-conductive material is alumina.

8. The process of claim 1, wherein the electrically non-conductive material is about 60 to 90% dense.

9. The process of claim 1, wherein the electrically non-conductive material is about 65 to 80% dense.

10. The process of claim 1, wherein the coefficients of thermal expansion differ by less than about 50%.

11. The process of claim 1, wherein the coefficients of thermal expansion differ by less than about 35%.

12. A ceramic igniter comprising a body member composed of an electrically conductive ceramic material, said body member having at least one slot extending therethrough and an electrically non-conductive material disposed within and substantially filling the slot.

13. The igniter of claim 12, wherein the electrically non-conductive material has a coefficient of thermal expansion substantially the same as that of the electrically conductive material.

14. The igniter of claim 12, wherein the electrically non-conductive material is selected from the group consisting of alumina, beryllium oxide, and aluminum nitride.

15. The igniter of claim 14, wherein the electrically non-conductive material is alumina.

16. The igniter of claim 12, wherein the electrically conductive ceramic material is a mixture of a nitride ceramic and a conductive component selected from any of molybdenum disilicide, silicon carbide, or a mixture thereof.

17. The igniter of claim 12, wherein the non-electrically conductive material is physically bonded to the electrically conductive material.

* * * * *